United States Patent [19]

Barkus

[11] Patent Number: 4,505,529

[45] Date of Patent: Mar. 19, 1985

[54] ELECTRICAL CONNECTOR FOR USE BETWEEN CIRCUIT BOARDS

[75] Inventor: Lee A. Barkus, Millersburg, Pa.

[73] Assignee: AMP Incorporated, Harrisburg, Pa.

[21] Appl. No.: 547,604

[22] Filed: Nov. 1, 1983

[51] Int. Cl.[3] ..... H01R 23/72

[52] U.S. Cl. ..... 339/17 M; 339/254 M

[58] Field of Search ..... 339/17 M, 17 LM, 17 CF, 339/252 R, 254 M, 48, 49 B

[56] References Cited

U.S. PATENT DOCUMENTS

| | | | |
|---|---|---|---|
| 1,567,474 | 12/1925 | Tomlinson | 339/48 |
| 4,161,346 | 7/1979 | Cherian et al. | 339/17 M |
| 4,199,209 | 4/1980 | Cherian et al. | 339/59 M |

OTHER PUBLICATIONS

IBM Bulletin, Faure et al., vol. 17, No. 2, pp. 444 and 445, 7-1974.

IBM Bulletin, Bruder et al., vol. 17, No. 2, pp. 638 and 639, 7-1974.

*Primary Examiner*—Neil Abrams

*Attorney, Agent, or Firm*—Allan B. Osborne

[57] ABSTRACT

The present invention relates to a connector for electrically interconnecting two devices such as printed circuit boards, a printed circuit board and active device substrate and so forth. More particularly, the connector includes a contact element formed with three elongated beams extending between and connecting contact surfaces at each end and which buckle under compression to provide spring forces.

2 Claims, 5 Drawing Figures

ELECTRICAL CONNECTOR FOR USE BETWEEN CIRCUIT BOARDS

BACKGROUND OF THE INVENTION

1. Field of the Invention

This invention is in the field of surface to surface, electrical interconnecting devices for printed circuit boards, active device substrates and the like.

2. Description of the Prior Art

Examples of prior art connectors having surface to surface contact elements include U.S. Pat. Nos. 4,161,346 and 4,199,209. The connector disclosed in U.S. Pat. No. 4,161,346 includes a housing having vertical openings therethrough and contact elements having a symmetrical, sinuous shape positioned in the openings. The sinuous shape provides a spring section for exerting a predetermined contact force thru the contact surfaces at each end.

The connector disclosed in U.S. Pat. No. 4,199,209 includes contact elements having symmetrical S-shaped sections to provide a predetermined contact force. The contact elements are embedded in an elastomeric material with the contact surfaces at each end being exposed on opposite surfaces for engagement with circuit boards and the like.

SUMMARY OF THE INVENTION

The invention disclosed herein is a connector which includes contact elements having three elongated beams extending between and attached to contact surfaces and a housing adapted to receive the elements. The beams are adapted to buckle out under compression to provide spring pressure for biasing the contact surfaces against conductive traces and pads on circuit boards and substrates between which the connector is positioned.

DESCRIPTION OF THE INVENTION

Figure 1:
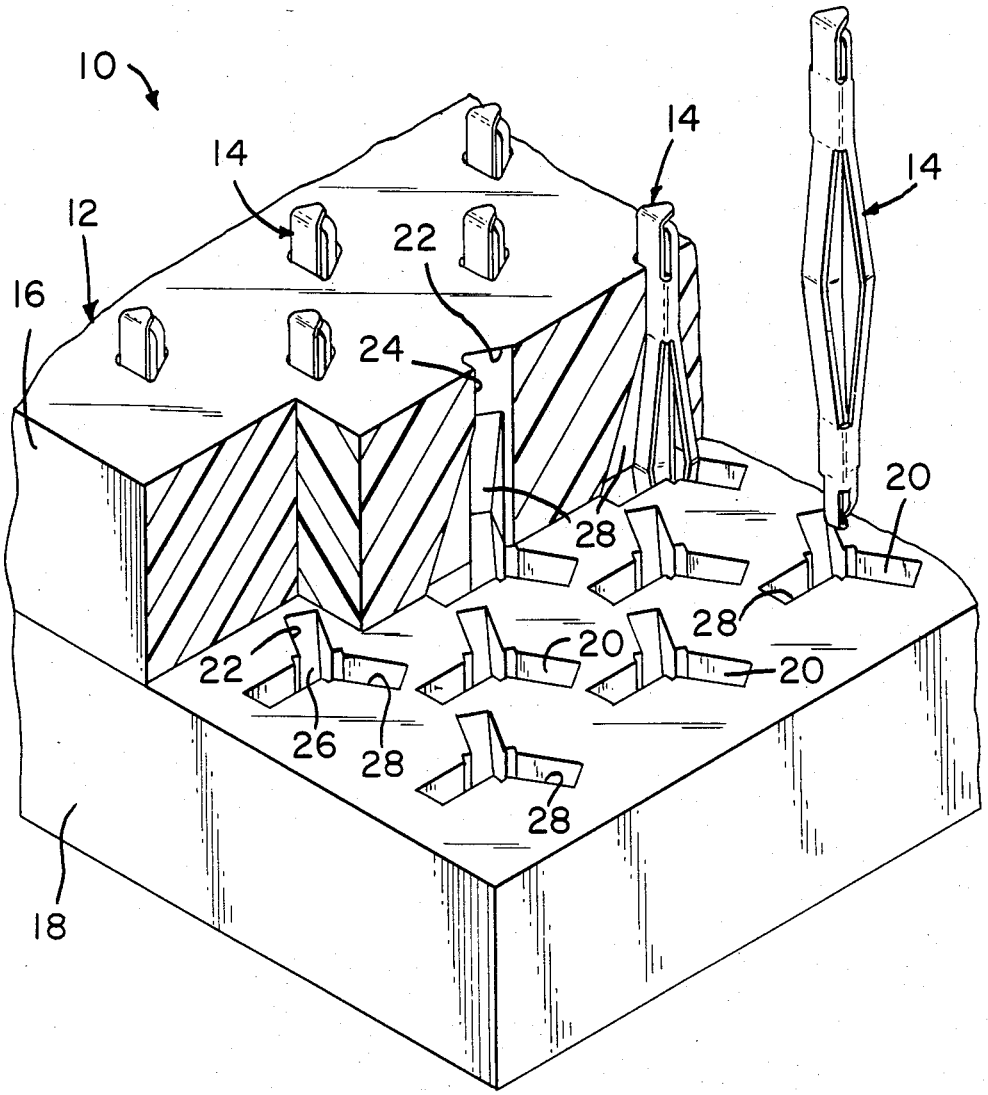
FIG. 1 is an isometric view of the connector of the present invention with the housing partially sectioned and with a contact element exploded out.

With reference to FIG. 1, connector 10 includes housing 12 and contact elements 14.

Housing 12 has upper and lower sections 16 and 18 respectively. These sections are identical and can be joined either permanently; e.g., by ultrasonic bonding (if a material suitable therefore is used) or by mechanic means; e.g., screws, bolts, latches, etc. The reason for the housing to be in two horizontal layers is to accommodate the loading of contact elements 14 thereinto. A thermoplastic material is preferred with molding as the preferred method of making the sections.

Figure 2:
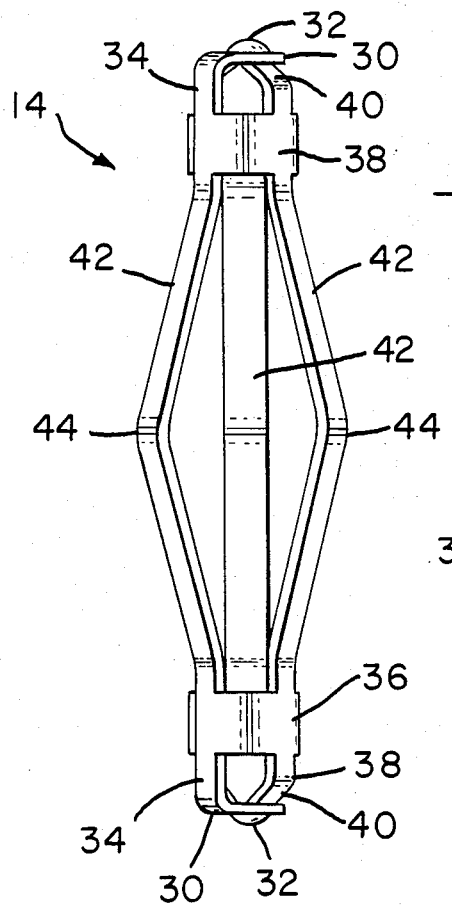
FIG. 2 is an isometric view of a contact element of the present invention.
Figure 4:
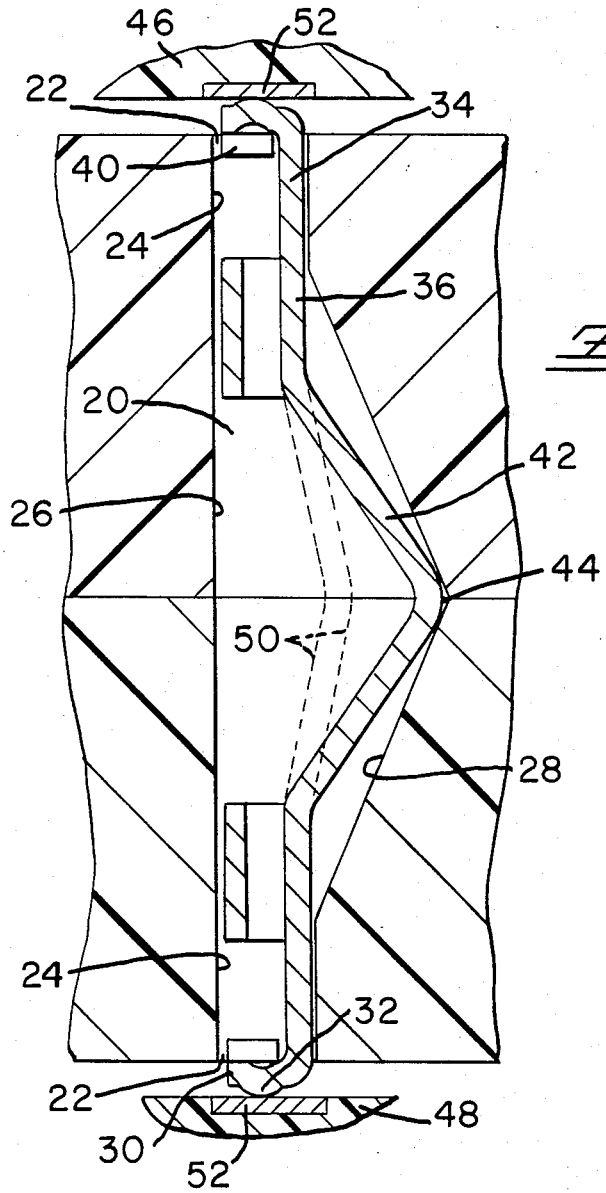
FIG. 4 is a cross-sectional view of the connector of FIG. 1 showing a contact element in engagement with devices having conductive traces thereon.

The sections when joined cooperate to form a plurality of vertically extending passages 20 with openings 22 on both the upper and lower surfaces (FIG. 2). As the housing and also the connector is preferably symmetrical in all respects, the orientation; e.g., upper-lower, is relative. However, it may be desirable to having indexing or polarizing features (not shown). The half passage in one section is a mirror image of the half passage in the other section. With reference to FIG. 4, as well as FIG. 1, each passage includes two neck portions 24 which joins openings 22 to the interior of the passage. The interior has an axial portion 26 with three beam-receiving concave recesses 28 projecting outwardly from the axial portion. The recesses which are spaced equal-distance, one from the other, about the axial portion, increase in distance from the center line with the maximum being at the axial center with the center being at the boundary between the housing sections which are of equal thickness.

The housing can be of any dimension, one significant feature of the passage configuration and structure of the contact elements is that a staggered grid providing a dense array can be achieve.

Contact elements 14 are preferably stamped and formed from berylium copper. With reference to FIG. 2, each element includes at each end upper and lower contact surfaces 30. These surfaces may carry boss 32 to provide a high pressure contact point. The surfaces, which are normal to the axis of the element, are bent over extensions of strap 34 extending from collars 36. Support members 38, also extending outwardly from collar 36, include a beveled free end 40 which is positioned under and supports surface 30.

Three elongated beams 42 extend between and are attached to both collars 36. The beams are formed to bend out laterally with the reversion point, indicated by reference numeral 44, being at the axial center of the contact element.

Figure 3:
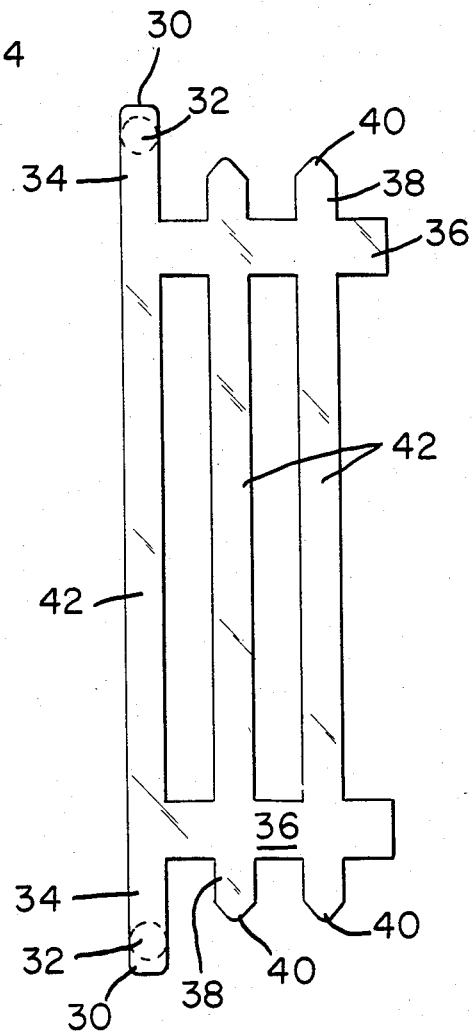
FIG. 3 is a stamped, unformed contact element.

FIG. 3 is a blank of a contact element. Most of the structural features, although not formed, are indicated by the same reference numerals as used in FIG. 2. After being stamped, the blank is formed into a contact element by bringing one side around to the other, and appropriately bending contact surfaces 30, beveled free ends 40 and beams 42.

FIG. 4 is a cross-sectional view of connector 10 positioned between an active device substrate 46 and circuit board 48, both of which are shown only as fragments. The drawing in the Figure includes dashed lines 50 which indicate the position of a beam 42 prior to being compressed; i.e., the beam is in a relaxed condition. In this regard, FIG. 1 shows how the elements, and more particularly the contact surfaces 30 and collars 36 extend above openings 22 in the relaxed state. In use, the substrate and circuit board are forced against the contact elements, pushing them into passages 20 and causing the beams to buckle outwardly, deeper into recesses 28. Being resilient, the beams act as spring members and urge the contact surfaces, and bosses 32 if present, outwardly against conductive traces (or pads) 52 on the substrate and board. Constant pressure is maintained against the traces to provide electrical contact and prevent movement between the traces and contact surfaces (bosses).

Figure 5:
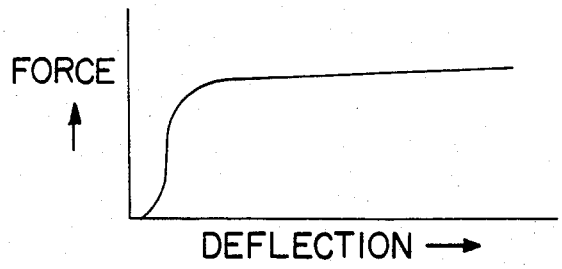
FIG. 5 is a force-deflection curve for the contact element.

FIG. 5 is a force deflection curve showing that initially a relative high force is required to begin beam buckling but that thereafter, relatively low increments of force cause substantially greater beam deflection.

A substrate and circuit board combination was used to illustrate how the connector of the present invention may be utilized. Other combinations of course are equally acceptable; e.g., tow circuit boards.

The present invention may be subject to many modifications and changes without departing from the spirit or essential characteristics thereof. The present embodiment is therefore intended in all respects as being illustrative and not restrictive of the scope of the invention.

I claim:

1. A connector for being positioned between and electrically interconnecting two devices having conductive traces such as printed circuit boards, comprising:

a. a housing of insulating material having a plurality of vertical passages therethrough with each passage having three longitudinally extending recesses spaced around the circumference thereof; and b. a plurality of contact elements having a pair of spaced apart collars with three circumferentially spaced, elongated beams attached to and extending there between, each beam being formed to bend out laterally with a reversion point thereon being at the axial center of the element, and further having a contact surface attached to each collar and extending axially away therefrom, said contact elements being positioned in the passages with the contact surfaces extending outwardly therefrom and with each beam being in alignment with and adapted to be buckled into a recess by a compressive force which may be applied against the contact surfaces.

2. The connector of claim 1 wherein the contact element further includes support members which are attached to the collars and extend inwardly of the collars and under the contact surfaces for support thereof.

* * * * *